US009291035B2

(12) United States Patent
Cooper

(10) Patent No.: US 9,291,035 B2
(45) Date of Patent: Mar. 22, 2016

(54) WELLBORE CLEANING APPARATUS AND METHOD

(71) Applicant: Weatherford Switzerland Trading and Development GmbH, Zug (CH)

(72) Inventor: Ruairidh Cooper, Banchory (GB)

(73) Assignee: Weatherford Switzerland Trading and Development GMBH, Zug (CH)

( * ) Notice: Subject to any disclaimer, the term of this patent is extended or adjusted under 35 U.S.C. 154(b) by 603 days.

(21) Appl. No.: 13/683,098

(22) Filed: Nov. 21, 2012

(65) Prior Publication Data

US 2013/0140028 A1 Jun. 6, 2013

(30) Foreign Application Priority Data

Dec. 1, 2011 (GB) ..... 1120694.3

(51) Int. Cl.
*E21B 37/00* (2006.01)
*E21B 27/00* (2006.01)

(52) U.S. Cl.
CPC ..... *E21B 37/00* (2013.01); *E21B 27/00* (2013.01)

(58) Field of Classification Search
CPC ..... E21B 37/00; E21B 37/02; E21B 37/04; E21B 27/04; E21B 43/02; E21B 43/08
USPC ..... 166/177.7, 56, 205, 236, 105.1
See application file for complete search history.

(56) References Cited

U.S. PATENT DOCUMENTS 3,799,258 A 3/1974 Tausch
4,603,739 A * 8/1986 Krugh ..... 166/311
4,944,351 A 7/1990 Eriksen et al.
4,981,177 A 1/1991 Carmody et al.
5,496,044 A 3/1996 Beall et al.
5,682,950 A 11/1997 Bjømstad
5,799,949 A 9/1998 Beall et al.
6,155,343 A 12/2000 Nazzal et al.
6,250,387 B1 6/2001 Carmichael et al.
6,260,850 B1 7/2001 Beall et al.
6,283,477 B1 9/2001 Beall et al.
6,523,614 B2 2/2003 Dennistoun et al.
6,607,031 B2 8/2003 Lynde et al.
6,659,185 B2 12/2003 Dennistoun et al.

(Continued)

OTHER PUBLICATIONS

EP Search Report for Application No. 12194066.2-1610 dated Feb. 19, 2013.

*Primary Examiner* — Kenneth L Thompson
*Assistant Examiner* — Steven MacDonald
(74) *Attorney, Agent, or Firm* — Patterson & Sheridan, LLP

(57) ABSTRACT

A debris collecting tool for use within a wellbore is provided. The tool comprises a filter body having an upstream end and a downstream end. A first fluid passage extends longitudinally between the upstream and downstream ends of the filter body, and at least one second fluid passage connects the first fluid passage with the exterior of the filter body. A filter is located between the first fluid passage and the at least one second fluid passage. The tool further comprises a flow controller movable between a first position in which fluid is prevented from entering the at least one second fluid passage from the exterior of the filter body, and a second position in which fluid is permitted to enter the at least one second fluid passage from the exterior of the filter body. An agitator body is attached to the upstream end of the filter body, and includes at least one radially projecting agitation member. Methods of using the tool to collect debris and clean a wellbore are also provided.

31 Claims, 4 Drawing Sheets

(56) References Cited

U.S. PATENT DOCUMENTS

| | | | |
|---|---|---|---|
| 6,695,058 | B1 | 2/2004 | French |
| 6,742,595 | B2 | 6/2004 | Dennistoun et al. |
| 6,776,231 | B2 | 8/2004 | Allen |
| 6,880,641 | B2 | 4/2005 | Dennistoun et al. |
| 6,951,251 | B2 | 10/2005 | Penisson |
| 6,953,093 | B2 | 10/2005 | Dennistoun et al. |
| 7,032,672 | B2 | 4/2006 | Dennistoun et al. |
| 7,040,395 | B2 | 5/2006 | Booth |
| 7,188,674 | B2 | 3/2007 | McGavern, III et al. |
| 7,249,635 | B2 | 7/2007 | Dennistoun et al. |
| 7,455,113 | B2 | 11/2008 | Booth |
| 7,475,733 | B2 | 1/2009 | Dennistoun et al. |
| 7,497,260 | B2 | 3/2009 | Telfer |
| 7,621,331 | B2 | 11/2009 | Mescall et al. |
| 7,775,269 | B2 | 8/2010 | Dennistoun et al. |
| 8,066,059 | B2 | 11/2011 | Ferguson et al. |
| 8,336,617 | B2 | 12/2012 | Knobloch et al. |
| 8,403,049 | B2 | 3/2013 | Ferguson et al. |
| 8,453,724 | B2 | 6/2013 | Zhou |

* cited by examiner

WELLBORE CLEANING APPARATUS AND METHOD

BACKGROUND OF THE INVENTION

1. Field of the Invention

The present invention relates to the field of wellbore drilling, and more particularly to the cleaning of wellbores after a drilling operation is complete. The present invention provides an improved apparatus and method for collecting and removing debris left in the wellbore after the drilling operation.

2. Description of the Related Art

During wellbore cleaning operations debris within the well is removed from the casing wall and flushed out by circulating drilling mud. However, debris will often remain in the well when completion fluid displaces the drilling mud and consequently a filtration tool may be deployed to capture this remaining debris. In deviated or horizontal wells, the filtration tool will not capture all of the remaining debris as some of the debris will have settled on the low side of the wellbore casing away from the main fluid stream. In many wellbore completions the cleanliness of the wellbore is crucial, either due to the type of completion or the properties of the associated reservoir. Debris remaining on the low side of the casing is therefore unacceptable, as a relatively empty filter tool can give a false impression of the cleanliness of the wellbore.

One solution to this problem has been to maximise the flow rates within the wellbore during the cleaning operation. However, this solution increases the cost of the operation due to the additional energy consumption by the pumps to generate the increased flow. It is also only partly successful as debris picked up by the increased flow may still settle back down on the low side of the casing in deviated or horizontal wells.

An alternative solution is to employ one or more impellers which are non-rotatably fixed to the drill string, where rotation of the drill string will rotate the impeller(s) and agitate or disturb the debris off the low side of the casing and into the circulating fluid flow out of the well. However, as with the increased flow rate solution, the debris can return to the low side of the casing if it moves towards the outside of the flow on the way along the well.

It is an aim of the present invention to obviate or mitigate the disadvantages of these existing cleaning apparatus and methods.

SUMMARY OF THE INVENTION

According to a first aspect of the invention there is provided a debris collecting tool for use within a wellbore, the tool comprising:

a filter body having an upstream end and a downstream end;

a first fluid passage extending longitudinally between the upstream and downstream ends of the filter body, and at least one second fluid passage connecting the first fluid passage with the exterior of the filter body;

a filter located between the first fluid passage and the at least one second fluid passage;

a flow controller movable between a first position in which fluid is prevented from entering the at least one second fluid passage from the exterior of the filter body, and a second position in which fluid is permitted to enter the at least one second fluid passage from the exterior of the filter body; and an agitator body attached to the upstream end of the filter body, the agitator body including at least one radially projecting agitation member.

The at least one agitation member may be non-rotatably attached to the agitator body. Alternatively, the at least one agitation member may be rotatably attached to the agitator body.

The agitator body may further comprise at least one pair of radially projecting agitation members, the agitation members being located at diametrically opposed locations upon the agitator body and each projecting in opposite radial directions.

The agitator body may further comprise a number of pairs of radially projecting agitation members, each pair of agitation members being rotationally offset from an adjacent pair of agitation members.

The agitator body may further comprise at least one pair of radially projecting agitation members, each agitation member being axially spaced from the other and rotatable relative to the agitator body. Each of the at least one pair of agitation members may have an outer end which is weighted such that the agitation member is biased towards a particular position irrespective of any rotational motion of the agitator body.

Alternatively, the agitator body may further comprise at least one pair of radially projecting agitation members, each agitation member being axially spaced from the other and non-rotatably attached to the agitator body. Each agitation member of the at least one pair of agitation members may be attached to the agitator body at a different rotational angle to that of the other member of the pair.

The outer end of the at least one agitation member may include an aperture such that fluid may flow through the agitation member.

The agitator body may further comprise a plurality of centralising blades extending radially outward therefrom. A first radial distance from an outer end of the at least one agitation member to a longitudinal axis of the tool is less than a second radial distance from an outer end of each centralising blade to the longitudinal axis of the tool.

The at least one agitation member may be axially movable relative to the agitator body between a first position in which the agitation member is non-rotatable relative to the agitator body, and a second position in which the agitation member is rotatable relative to the agitator body.

The at least one agitation member may have a first, upstream surface which is concave.

The at least one agitation member may be an impeller blade which rotates relative to the agitator body as the tool is pulled through the wellbore.

According to a second aspect of the invention there is provided a method of collecting debris within a wellbore, the method comprising the steps of:

lowering a workstring into the wellbore, the workstring including at least one debris collecting tool according to the first aspect of the invention having the flow controller in the first position;

moving the flow controller of the at least one debris collecting tool from the first position to the second position once the workstring and at least one debris collecting tool are at a desired position within the wellbore; and retrieving the workstring from the wellbore.

According to a third aspect of the invention, there is provided a method of cleaning a wellbore, the method comprising the steps of:

lowering a workstring into the wellbore, the workstring including a scraper tool and at least one debris collecting tool according to the first aspect of the invention having the flow controller in the first position;

operating the scraper tool to remove debris from an interior surface of the casing;

circulating drilling fluid through the wellbore to remove the debris from the wellbore;

displacing any drilling fluid remaining in the wellbore with a completion fluid;

moving the flow controller of the at least one debris collecting tool from the first position to the second position; and retrieving the workstring from the wellbore such that the completion fluid is directed through the filter body of the at least one debris collecting tool.

The method may further comprise the step of moving the at least one agitation member axially relative to the agitator body from a first position in which the agitation member is non-rotatable relative to the agitator body to a second position in which the agitation member is rotatable relative to the agitator body when the workstring and debris collecting tool are to be retrieved from the wellbore.

Alternatively, the method may further comprise the step of moving the at least one agitation member axially relative to the agitator body from a first position in which the agitation member is rotatable relative to the agitator body to a second position in which the agitation member is non-rotatable relative to the agitator body when the workstring and debris collecting tool are to be retrieved from the wellbore.

The workstring may not be rotated relative to the wellbore during the retrieval step.

The workstring may include first and second debris collecting tools according to claim 1, wherein the first debris collecting tool has its flow controller initially in the first position and the second debris collecting tool has its flow controller initially in the second position, and wherein the step of moving the flow controller of the at least one debris collecting tool from the first position to the second position may comprise moving the flow controller of the first debris collecting tool from the first position to the second position, and may further comprise moving the flow controller of the second debris collecting tool from the second position to the first position.

According to a fourth aspect of the invention, there is provided a method of collecting debris within a wellbore, the method comprising the steps of:

lowering a workstring into the wellbore, the workstring including a debris collecting tool according to claim 1 having the flow controller in the second position;

moving the flow controller of the debris collecting tool from the second position to the first position once the workstring and debris collecting tool are at a desired position within the wellbore; and retrieving the workstring from the wellbore.

BRIEF DESCRIPTION OF THE DRAWINGS

A preferred embodiment of the present invention will now be described, by way of example only and with reference to the accompanying drawings, in which.

DETAILED DESCRIPTION

Figure 1:
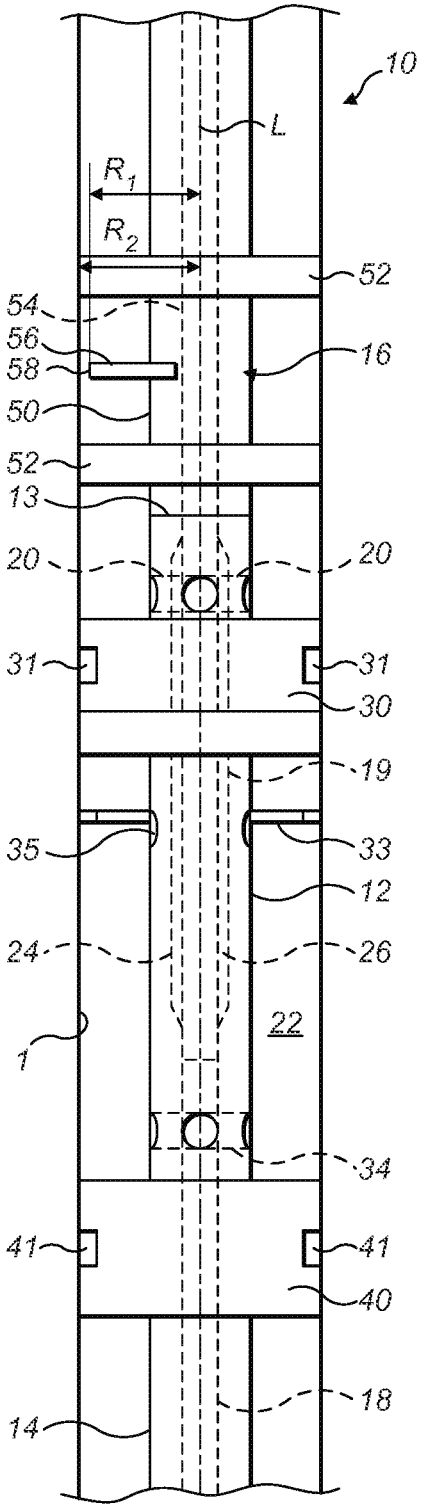
FIG. 1 is a schematic view of a debris collecting tool within a wellbore casing.

FIG. 1 is a schematic illustration of a debris collecting tool according to the present invention. The tool 10 is shown located within a wellbore casing 1, and comprises a filter body 12 and an agitator 16 attached to an upstream end 13 of the filter body 12. A downstream end 14 of the filter body 12 includes a threaded connection (not shown) for attaching further components of a workstring to the tool 10 if required. For avoidance of doubt, the term "upstream" refers to the end 13 of the filter body 12 which is the leading end of the body 12 when the tool 10 is filtering fluid within a wellbore casing. The term "downstream" refers to the end of the filter body which is the leading end of the body 12 when the tool 10 is not filtering fluid.

The filter body 12 has a first internal fluid passage 18 which extends along longitudinal axis L between the upstream and downstream ends 13,14 of the body 12. A number of second internal fluid passages 20 extend radially outwards from the first fluid passage 18 and connect the first passage 18 with the exterior of the body 12 and hence, in use, an annular gap 22 between the body 12 and the casing 1. An intermediate portion 19 of the first passage 18 has a larger diameter than the remainder of the first passage 18, and a filter element 24 having a smaller diameter than the intermediate portion 19 is located therein.

The filter element 24 may comprise a mesh or slotted screen, and is located between the first and second passages 18,20 and the downstream end 14 of the body 12 such that any fluid flowing between the two passages must pass through the filter element 24. As a result, any particles of sufficient size which are carried by the fluid flow will be trapped in an annular chamber, or sump, 26 defined between the inner surface of the intermediate portion 19 of the first passage 18 and an outer surface of the filter element 24.

A first flow controller, shown here in the form of an axially-sliding sleeve 30, is provided on the body 12 where the second passage(s) 20 exit the body 12. The sleeve 30 may slide between a first position in which the second passages 20 are closed to the exterior of the body 12, and a second position in which the second passages 20 are open. It is this second position which is shown in FIG. 1. The exterior of the sleeve 30 may include one or more friction pads or rings 31 which project from the sleeve 30 such that, in use, they are in frictional contact with the casing 1. An annular seal 33 projects radially outwards from the filter body 12 at a location below, or downstream, of the second passages 20 and their respective sleeve 30. When the tool is within a casing 1 the seal 33 contacts the casing wall and prevents fluid flowing past the tool in the annular gap 22 between the tool and the casing 1. The filter body 12 may include one or more bypass channels 35 and the seal 33 may be capable of axial movement along the body 12 between a first position in which fluid may bypass the seal 33 via the channel(s) 35 and a second position in which fluid may not bypass the seal 33.

A number of third fluid passages 34 may be provided towards the downstream end 14 of the body 12. As with the second passages 20, the third passages 34 fluidly connect the first passage 18 with the exterior of the body 12. A second flow controller, shown here in the form of a second axially-sliding sleeve 40, may be provided on the body 12 where the third passages 34 exit the body 12. The second sleeve 40 may slide between a first position in which the third passages 34 are closed to the exterior of the body 12, and a second position in which the third passages 34 are open. Again, it is this second position which is shown in FIG. 1. The exterior of the second sleeve 40 may include one or more friction pads or rings 41 which project from the sleeve 40 such that, in use, they are in frictional contact with the casing 1.

The agitator 16 attached to the upstream end 13 of the filter body 12 comprises an elongate agitator body 50 and at least one pair of radially projecting centralisers 52. The agitator body 50 contains a fluid passage 54 extending longitudinally through the agitator 16, so that drilling fluids from further up the workstring can pass through the agitator 16 into the passages of the filter body 12. The centralisers 52 are axially spaced from one another along the agitator body 50, and each comprises a number of radially projecting blades. Each blade is of sufficient length that the outer ends of each blade may contact the inner surface of the casing 1 and keep the agitator 16 and filter body 12 substantially central within the casing 1.

Figure 1A:
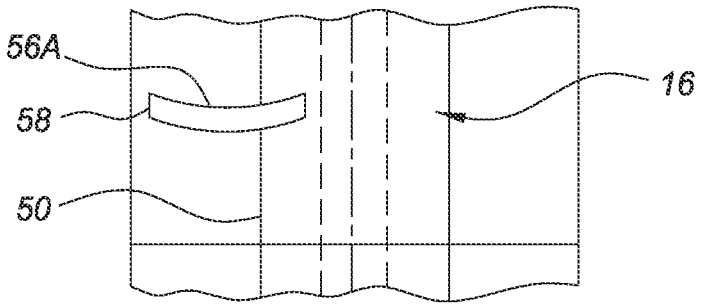
FIG. 1A is an enlarged view of one embodiment of an agitation member.

At least one agitation member 56 projects radially from the agitator body 50 towards the casing 1. A radial distance R1 from the outer end 58 of the agitation member 56 to the longitudinal axis L of the tool is less than a radial distance R2 from the outer end of each centraliser blade to the longitudinal axis L. Thus, the outer end 58 of the agitation member 56 does not contact the casing 1 during operation. The agitation member 56 may be non-rotatable relative to the agitator body 50, or else it may be attached in such a way that it is rotatable relative to the agitator body 50. The rotatable agitation member may be an impeller blade which is adapted to rotate relative to the agitator body 50 as the tool is pulled through fluid within the wellbore. The agitation member 56A may have a first, upper surface which is concave or cup-shaped, as shown in FIG. 1A.

The manner in which the tool of FIG. 1 operates will now be described. The tool may be lowered into the completed wellbore on its own, but it is more likely that the tool will be part of a workstring containing a number of wellbore cleaning components. In either case, the tool of the present invention is intended for use once a number of wellbore cleaning steps have already been taken. Firstly, debris is removed from the interior surface of the casing, typically by the operation of a known scraper tool. Drilling fluid, or mud, is then circulated down through the workstring and back up the casing to remove that debris from the wellbore. A completion fluid is then pumped into the wellbore to displace the drilling fluid. In spite of these various procedures a certain amount of debris may still reside within the casing, particularly in deviated or horizontal sections where the debris will settle on the low side of the casing.

As the debris collecting tool is lowered into the casing, the friction forces generated between the friction pads 31,41 of the sleeves 30,40 and the casing wall ensure that the sleeves 30, 40 remain in their first, or upper, position. In this first position, the second and third passages 20,34 are closed so that no fluid may flow into or out of the passages 20,34 from the exterior of the filter body 12. Similarly, friction between the seal 33 and the casing 1 keeps the seal 33 in its first position. In the likely event that the tool is lowered into the well before the wellbore is circulated, the circulating fluids are pumped down through the tool via the respective passages 54, 18 of the agitator 16 and filter body 12. With the seal 33 in its first position, circulating fluids returning up the annular gap 22 between the tool and the casing 1 can bypass the seal 33 via the bypass channels 35 in the filter body 12.

When it is time to collect the remaining debris, the workstring and tool are pulled upwards towards top side of the wellbore. This upward movement generates friction forces on the sleeves 30, 40 via their respective friction pads 31,41 which force the sleeves 30,40 downwards relative to the filter body 12. Consequently, the sleeves 30, 40 move away from the outlets of the second and third passages 20,34, thereby opening those passages to the exterior of the filter body 12. Similarly, the friction between the seal 33 and casing 1 forces the seal 33 along the filter body 12 into its second position in which the bypass channels 35 are closed. Consequently, as the tool is pulled upwards towards top side the completion fluid within the casing will not be able to bypass the seal 33 on the outside and instead will be forced into the filter body through the second passages 20.

As the tool is pulled upwards, the agitation member 56 on the agitator 16 generates turbulence within the completion fluid close to the casing wall. This turbulence may be enhanced by rotating the workstring as it is pulled upwards. Where the agitation member 56 may rotate relative to the body 50 the workstring does not need to be rotated as it is retrieved. This turbulence stirs up any debris lying along the wall. That debris is then carried into the filter body 12 with the completion fluid entering the second passages 20. Once within the filter body 12, the completion fluid passes through the filter element 24, and out of the body 12 via the first and third passages 18,34. Any debris within the fluid entering the filter body 12 is trapped within the filter chamber 26 and cannot leave the filter body 12. Once at top side, the filter chamber 26 can simply be emptied, and the tool is then ready to be used again.

Figure 2A:
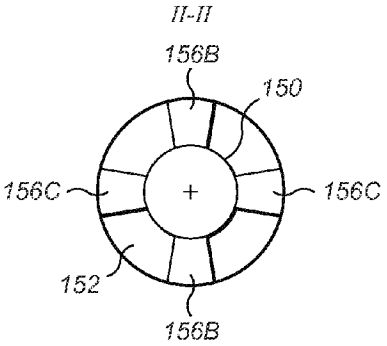
FIGS. 2(*a*) and 2(*b*) are cross section and side views of a first alternative embodiment of an agitator for use in the tool.
Figure 2B:
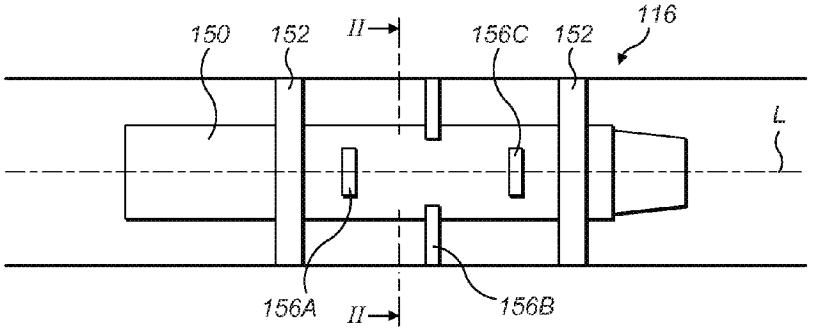
Figure 3A:
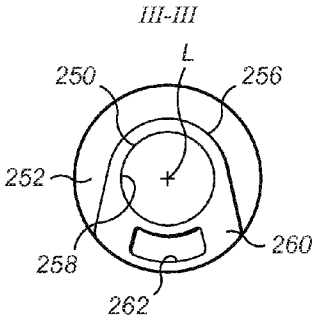
FIGS. 3(*a*) and 3(*b*) are cross section and side views of a second alternative embodiment of an agitator for use in the tool.
Figure 3B:
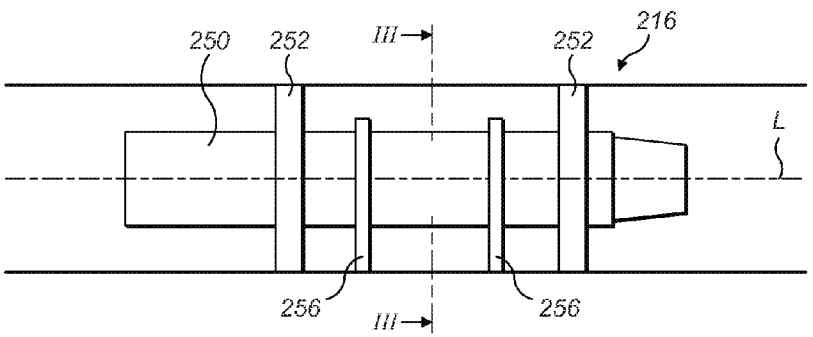
Figure 4A:
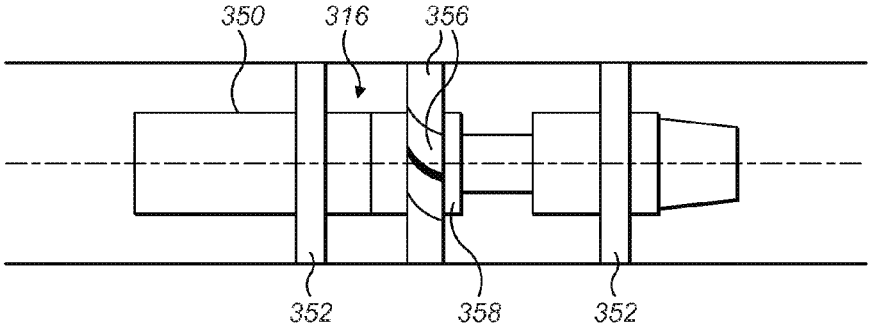
FIGS. 4(*a*) and 4(*b*) are side views of a third alternative embodiment of an agitator for use in the tool.
Figure 4B:
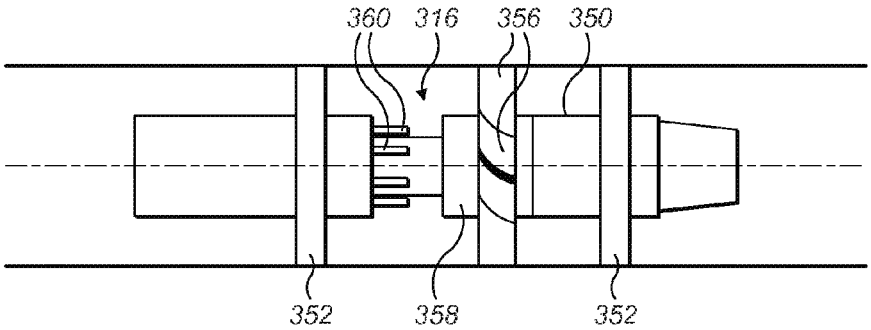

A number of alternative embodiments of the agitator are shown in FIGS. 2-4. Unless otherwise stated, these alternative agitators are utilised in the debris collecting tool and method in the same manner as already described above. In the first alternative embodiment shown in FIGS. 2(*a*) and 2(*b*), the agitator 116 is similar to that shown in FIG. 1, in that it is intended to be attached to the upstream end of the filter body and comprises an elongate agitator body 150 and at least one pair of radially projecting centralisers 152 of the same type as described above. However, this embodiment includes at least one pair of radially projecting agitation members in the form of blades 156, which are located at diametrically opposed locations upon the agitator body 150 and project in substantially opposite directions from the body 150. In the alternative embodiment illustrated, there are three pairs of blades 156A-156C axially spaced along the body 150, with the first and third pairs 156A,156C rotationally offset from the second pair 156B about the longitudinal axis L. The rotational offset of the first and third pairs 156A,156C relative to the second pair 156B is substantially 90 degrees.

In the second alternative embodiment shown in FIGS. 3(*a*) and 3(*b*), the agitator 216 is again intended to be attached to the upstream end of the filter body and comprises an elongate agitator body 250 and at least one pair of radially projecting centralisers 252 of the same type as described above. The agitator 216 further comprises at least one pair of radially projecting agitation members 256, which are axially spaced from one another and rotatable relative to the agitator body 250. As seen best in FIG. 3(*a*), the agitation members 256 are generally ring shaped and have a central aperture 258 co-axial with the longitudinal axis L. The agitator body 250 passes through the aperture 258 and hence the member 256 is supported on the agitator body 250 and may rotate relative thereto. Each member 256 also has a wing, or blade, portion 260 which projects radially outward from the axis L on only one side of the ring member 256. Hence, each member 256 is asymmetrical and weighted by the blade portion 260 such that it is biased towards a particular position irrespective of the rotational motion or position of the body 250. Thus, when the agitator 250 is in a deviated or horizontal wellbore, the members 256 will be predisposed towards the low side of the casing due to gravitational forces. Each member 256 may include a flow aperture 262 so as to not generate too much resistance to fluid flow as the tool passes along the casing.

FIG. 4 shows a third alternative embodiment of an agitator 316, which is switchable between first and second states shown in FIGS. 4(*a*) and 4(*b*), respectively. The agitator 316 is attachable to the upstream end of the filter body and comprises an elongate agitator body 350 and at least one pair of radially projecting centralisers 352 of the same type as described above. The agitator 316 further comprises at least one agitation member projecting radially from the agitator body 350. In the illustrated embodiment there are four agitation members in the form of impeller blades 356 which are circumferentially spaced from one another and project radially outwards from a hub member 358. The hub member 358 is adapted so that it may slide axially along the agitator body 350 from a first position shown in FIG. 4(*a*) where the hub is non-rotatably coupled to the body 350, and a second position shown in FIG. 4(*b*) in which the hub may rotate relative to the body 350.

The internal surface of the hub 358 may have a number of splines which engage with corresponding splines 360 on the body 350 and prevent the hub 358 from rotating in the first position. A number of mechanical fixtures such as, for example, shear pins (not shown) may prevent the hub 358 from moving axially from the first position as the tool is lowered into the wellbore. When it is time for the workstring and tool to be retrieved the shear pins can be broken in one of a variety of known ways such as, for example, applying a sufficient axial load to the workstring, or else by dropping a drop ball through the internal fluid passages of the workstring onto a ball seat below the hub and breaking the pins with a static or differential pressure generated at the hub 358.

Once the shear pins are broken, the hub 358 will slide axially into the second position, where it is free to rotate relative to the body 350. Thus, the third alternative embodiment provides an agitator in which the agitation member(s) may move from a non-rotatable position as the tool is lowered into the wellbore to a rotatable position for when the tool is retrieved. It should be pointed out that whilst this is the preferred arrangement, there is no reason why the arrangement could not be reversed if desired. The hub may therefore be rotatable in the first position whilst prevented from axial movement, and then dropped onto splines in a second, non-rotatable position for the retrieval phase.

By incorporating an agitator immediately upstream of a filter body in the present invention, any debris remaining in the wellbore after the initial wellbore cleaning and displacement of drilling fluid with completion fluid is stirred up and collected by the filter before it can settle within the wellbore. In this way the present invention ensures that any debris remaining in a wellbore can be effectively captured and filtered from the completion fluid, even in deviated or horizontal wells where the remaining debris tends to settle on the low side of the well. Thus, the present invention provides more thorough wellbore cleaning than with existing tools and methods, particularly in these deviated or horizontal types of well.

Whilst the tool is preferably utilised for filtering fluid within a wellbore whilst the workstring to which the tool is attached is being pulled out of the wellbore, it may alternatively be used when the workstring is being run into the wellbore. In such an instance, the tool would simply be attached to the workstring in the reverse orientation to that described above, with the "upstream" or leading end of the tool facing downward into the wellbore as opposed to upwards towards the surface. As the workstring and tool are run into the wellbore, the friction forces on the axially-sliding sleeves and annular seal would hold them in their second positions whereby the fluid in the wellbore can enter and exit the filter body via the second and third passages. As the workstring and tool are retrieved from the wellbore, the sleeves and seal will move to their first positions, thereby closing the filter passages and allowing the fluid to bypass the seal via the bypass channel in the filter body. Alternatively, the workstring may include at least two of the tools with at least one tool facing in the opposite direction to the other(s). In this way, at least one tool would filter wellbore fluid as the workstring was run into the wellbore and at least one other tool would filter fluid as the workstring was pulled out of the wellbore.

Additionally, two or more tools may be run simultaneously such that at least two of the tools are oriented to face in the same direction. The two or more tools may be placed in close proximity to, or relatively distant from, each other. The two or more tools may be configured such that the tool which is ahead of the other(s) while activated captures relatively large particles but allows smaller particles to pass, and at least one tool behind it captures at least a portion of the smaller sized particles.

Whilst it is preferred that the flow controllers used in the tool of the present invention are the axially-sliding sleeves described above, other flow controllers may be used instead. For example, hydraulically- or electrically-operated control valves may be used to open and close the second and third passages within the filter body.

In the first alternative embodiment of the agitator shown in FIG. 2, each pair of blades is preferably rotationally offset from an adjacent pair of blades by substantially 90 degrees. However, it should be understood that the invention is not limited to this specific angle of offset, and that other angles are also possible. For example, the rotational offset between adjacent pairs of blades may be in the range of 30-90 degrees, with 60 or 90 degrees being the most preferable angles within that range.

The blades of the second alternative embodiment are preferably rotatable relative to the agitator body. However, these blades may alternatively be non-rotatably fixed to the agitator body. In either case, the blades may also be fixed at different rotational angles relative to one another. For example, the blades may be arranged in a spiral or helical configuration about the agitator body. In the case of rotatable blades, these blades may be fixed at different rotational angles relative to one another on a blade carrier or hub, and the carrier/hub is supported by the agitator body and able to rotate relative thereto.

These and other modifications and improvements may be incorporated without departing from the scope of the present invention.

The invention claimed is:

1. A debris collecting tool for use within a wellbore, the tool comprising:

a filter body having an upstream end and a downstream end;

a first fluid passage extending longitudinally between the upstream and downstream ends of the filter body, and at least one second fluid passage connecting the first fluid passage with the exterior of the filter body;

a filter located between the first fluid passage and the at least one second fluid passage;

a flow controller movable between a first position in which fluid from the exterior of the filter body is prevented from entering the first fluid passage via the at least one second fluid passage, and a second position in which fluid from the exterior of the filter body is permitted to enter the first fluid passage via the at least one second fluid passage; and an agitator body attached to the upstream end of the filter body, the agitator body including at least one radially projecting agitation member, wherein the at least one radially projecting agitation member is configured to generate a turbulence when the tool is moved in the upstream direction.

2. The tool of claim 1, wherein the at least one agitation member is non-rotatably attached to the agitator body.

3. The tool of claim 2, wherein the agitator body further comprises at least one pair of radially projecting agitation members, each agitation member being axially spaced from the other and non-rotatably attached to the agitator body.

4. The tool of claim 3, wherein each agitation member of the at least one pair of agitation members is attached to the agitator body at a different rotational angle to that of the other member of the pair.

5. The tool of claim 1, wherein the at least one agitation member is rotatably attached to the agitator body.

6. The tool of claim 5, wherein the agitator body further comprises at least one pair of radially projecting agitation members, each agitation member being axially spaced from the other and rotatable relative to the agitator body.

7. The tool of claim 6, wherein each of the at least one pair of agitation members has an outer end which is weighted such that the agitation member is biased towards a particular position irrespective of any rotational motion of the agitator body.

8. The tool of claim 1, wherein the agitator body further comprises at least one pair of radially projecting agitation members, the agitation members being located at diametrically opposed locations upon the agitator body and each projecting in opposite radial directions.

9. The tool of claim 8, wherein the agitator body further comprises a number of pairs of radially projecting agitation members, each pair of agitation members being rotationally offset from an adjacent pair of agitation members.

10. The tool of claim 1, wherein an outer end of the at least one agitation member includes an aperture such that fluid may flow through the agitation member.

11. The tool of claim 1, wherein the agitator further comprises a plurality of centralizing blades extending radially outward from the agitator body.

12. The tool of claim 11, wherein a first radial distance from an outer end of the at least one agitation member to a longitudinal axis of the tool is less than a second radial distance from an outer end of each centralising blade to the longitudinal axis of the tool.

13. The tool of claim 1, wherein the at least one agitation member is axially movable relative to the agitator body between a first position in which the agitation member is non-rotatable relative to the agitator body, and a second position in which the agitation member is rotatable relative to the agitator body.

14. The tool of claim 1, wherein the at least one agitation member has a first, upstream surface which is concave.

15. The tool of claim 1, wherein the at least one agitation member is an impeller blade which rotates relative to the agitator body as the tool is pulled through the wellbore.

16. The tool of claim 1, wherein the flow controller comprises an axially movable sleeve.

17. The tool of claim 1, further comprising an annular seal disposed on the exterior of the filter body and downstream from the at least one second fluid passage.

18. The tool of claim 17, wherein the annular seal is axially movable relative to the filter body.

19. The tool of claim 17, further comprising one or more bypass channels for bypassing the annular seal.

20. The tool of claim 1, wherein the filter is configured to prevent debris from entering the first passage.

21. The tool of claim 1, wherein the flow controller is configured to move to the second position when the tool is being retrieved.

22. A method of collecting debris within a wellbore, the method comprising the steps of:

lowering a workstring into the wellbore, the workstring including at least one debris collecting tool according to claim 1 having the flow controller in the first position;

moving the flow controller of the at least one debris collecting tool from the first position to the second position once the workstring and at least one debris collecting tool are at a desired position within the wellbore by retrieving the workstring from the wellbore; and generating turbulence using the at least one agitation member during retrieval of the workstring.

23. The method of claim 22, further comprising the step of moving the at least one agitation member axially relative to the agitator body from a first position in which the agitation member is non-rotatable relative to the agitator body to a second position in which the agitation member is rotatable relative to the agitator body when the workstring and debris collecting tool are to be retrieved from the wellbore.

24. The method of claim 22, further comprising the step of moving the at least one agitation member axially relative to the agitator body from a first position in which the agitation member is rotatable relative to the agitator body to a second position in which the agitation member is non-rotatable relative to the agitator body when the workstring and debris collecting tool are to be retrieved from the wellbore.

25. The method of claim 22, wherein the workstring is not rotated relative to the wellbore during the retrieval step.

26. The method of claim 22, wherein the workstring includes first and second debris collecting tools according to claim 1, wherein the first debris collecting tool has its flow controller initially in the first position and the second debris collecting tool has its flow controller initially in the second position, and wherein the step of moving the flow controller of the at least one debris collecting tool from the first position to the second position comprises moving the flow controller of the first debris collecting tool from the first position to the second position, and further comprises moving the flow controller of the second debris collecting tool from the second position to the first position.

27. A method of cleaning a wellbore, the method comprising the steps of:

lowering a workstring into the wellbore, the workstring including the at least one debris collecting tool according to claim 1 having the flow controller in the first position;

circulating drilling fluid through the wellbore to remove the debris from the wellbore;

displacing any drilling fluid remaining in the wellbore with a completion fluid;

moving the flow controller of the at least one debris collecting tool from the first position to the second position;

retrieving the workstring from the wellbore such that the completion fluid is directed through the filter body of the at least one debris collecting tool; and generating turbulence using the at least one agitation member during retrieval of the workstring.

28. The method of claim 27, further comprising the step of moving the at least one agitation member axially relative to the agitator body from a first position in which the agitation member is non-rotatable relative to the agitator body to a second position in which the agitation member is rotatable relative to the agitator body when the workstring and debris collecting tool are to be retrieved from the wellbore.

29. The method of claim 27, further comprising the step of moving the at least one agitation member axially relative to the agitator body from a first position in which the agitation member is rotatable relative to the agitator body to a second position in which the agitation member is non-rotatable relative to the agitator body when the workstring and debris collecting tool are to be retrieved from the wellbore.

30. The method of claim 27, wherein the workstring is not rotated relative to the wellbore during the retrieval step.

31. The method of claim 27, wherein the workstring includes first and second debris collecting tools according to claim 1, wherein the first debris collecting tool has its flow controller initially in the first position and the second debris collecting tool has its flow controller initially in the second position, and wherein the step of moving the flow controller of the at least one debris collecting tool from the first position to the second position comprises moving the flow controller of the first debris collecting tool from the first position to the second position, and further comprises moving the flow controller of the second debris collecting tool from the second position to the first position.

* * * * *